US010597990B2

(12) United States Patent
Kleppa et al.

(10) Patent No.: US 10,597,990 B2
(45) Date of Patent: Mar. 24, 2020

(54) GAS LIFT VALVE

(71) Applicant: Petroleum Technology Company AS, Stanvanger (NO)

(72) Inventors: Erling Kleppa, Jørpeland (NO); Ståle Pettersen, Sandnes (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 0 days.

(21) Appl. No.: 15/316,760

(22) PCT Filed: Jul. 22, 2015

(86) PCT No.: PCT/EP2015/066721
§ 371 (c)(1),
(2) Date: Dec. 6, 2016

(87) PCT Pub. No.: WO2016/016057
PCT Pub. Date: Feb. 4, 2016

(65) Prior Publication Data

US 2018/0149001 A1 May 31, 2018

(30) Foreign Application Priority Data

Jul. 28, 2014 (NO) ..... 20140943

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS 2,797,700 A * 7/1957 McGowen, Jr. ..... E21B 43/123 137/155
3,160,113 A 12/1964 Meyers
(Continued)

FOREIGN PATENT DOCUMENTS

EP 2 708 696 A2 3/2014
GB 2 322 885 A 9/1998
(Continued)

OTHER PUBLICATIONS

Singaporean Written Opinion, dated Oct. 30, 2017, for Singaporean Application No. 11201610891S.

*Primary Examiner* — David J Bagnell
*Assistant Examiner* — Dany E Akakpo
(74) *Attorney, Agent, or Firm* — Birch, Stewart, Kolasch & Birch, LLP

(57) ABSTRACT

A gas lift valve for use in a hydrocarbon well includes an elongated valve housing including an inlet port for receiving a fluid from an annulus of a hydrocarbon well, and an outlet port for delivering the fluid to a production tubing of the hydrocarbon well, and an elongated, internal valve body, which is movable along a longitudinal, central axis of the valve housing between a first end position and a second end position. In the first end position, a sealing surface of the valve body is in sealing contact with a valve seat surface of the valve housing prohibiting the fluid to flow from the inlet port to the outlet port, and in the second end position the sealing surface is separated from the valve seat surface allowing the fluid to flow from the inlet port to the outlet port. The outlet port is positioned at a terminal end of the valve housing.

15 Claims, 5 Drawing Sheets

(56) References Cited

U.S. PATENT DOCUMENTS

| | | | | |
|---|---|---|---|---|
| 5,533,572 | A | 7/1996 | Brady et al. | |
| 2002/0096332 | A1 | 7/2002 | De Almeida | |
| 2003/0164240 | A1 | 9/2003 | Vinegar et al. | |
| 2004/0182437 | A1 | 9/2004 | Messick | |
| 2010/0212908 | A1* | 8/2010 | Stokka | E21B 43/123 166/319 |
| 2011/0127043 | A1* | 6/2011 | Hahn | E21B 43/123 166/373 |
| 2013/0094975 | A1* | 4/2013 | Stokka | E21B 43/123 417/54 |
| 2016/0290099 | A1* | 10/2016 | Balasubramanian | F03G 7/065 |

FOREIGN PATENT DOCUMENTS

| | | | |
|---|---|---|---|
| WO | WO 2004/092537 | A1 | 10/2004 |
| WO | WO 2007/091898 | A1 | 8/2007 |
| WO | WO 2015/132763 | A2 | 9/2015 |

* cited by examiner

GAS LIFT VALVE

The present invention relates to a gas injection valve. Specifically, the present invention relates to a gas injection valve for injection of gas into the production tubing of a hydrocarbon well.

In particular, the present invention relates to a gas lift valve for use in a hydrocarbon well, which gas lift valve comprises:

- an elongated valve housing comprising an inlet port for receiving a fluid from an annulus of a hydrocarbon well, and an outlet port for delivering the fluid to a production tubing of the hydrocarbon well, and
- an elongated, internal valve body, which is movable along a longitudinal, central axis of the valve housing between a first end position and a second end position, in which first end position a sealing surface of the valve body is in sealing contact with a valve seat surface of the valve housing prohibiting the fluid to flow from the inlet port to the outlet port, and in which second end position the sealing surface is separated from the valve seat surface allowing the fluid to flow from the inlet port to the outlet port.

Injection of gas into the production tubing of a hydrocarbon well in order to enhance the production of hydrocarbons is well known. Injection of gas into the produced well fluids flowing in the production tubing in the well will reduce the density and thus the hydrostatic pressure of the well fluids. With reduced hydrostatic pressure of the well fluids, improved flow of well fluids is achieved. For injection of gas into the well fluids in the production tubing, a gas lift valve is employed. The gas lift valve is basically a check valve that allows gas to flow through the gas lift valve in one direction while preventing flow of any fluid in the opposite direction. The gas lift valve is usually arranged in a side pocket mandrel of the production tubing allowing gas to be injected from the annulus surrounding the production tubing. When gas is to be injected into the production tubing, gas is injected into the annulus and when the pressure in the annulus reaches a given value the gas lift valve opens and allows gas to flow through the gas lift valve into the production tubing.

A problem with known gas lift valves is that scale tends to form on certain parts in the interior of the valve. When affected parts are movable parts, the integrity of the valve may over time be threatened. This is also the case for the valve parts that form the parts of the gas lift valve that forms part of the check valve that opens and closes the gas lift valve. To try and avoid the formation of scale, affected parts of the gas lift valve has been coated with various types of coatings. Scale continues, however, to form on these parts of gas lift valve, and frequent control and maintenance or repair of the gas lift valves is therefore necessary.

The formation of scale is believed to be due to the reservoir water which enters the outlet ports of the gas lift valve. This is schematically shown in FIG. 1 where a gas lift valve 3 is arranged in a side pocket 2 of the production tubing 1. As indicated with arrow 5 in the figure, reservoir water 4 in the produced well fluids enters the gas lift valve 3 through the openings 6 and wets movable interior parts of the gas lift valve. Over time scale is formed and the valve may in the end stop working properly.

The objective of the present invention is therefore to find a solution to the problem of formation of scale on gas lift valves as outlined above.

This objective is achieved with a gas lift valve as defined in independent claim 1. Further embodiments of the present gas lift valve are defined in dependent claims.

According to the invention, the outlet port is positioned at a terminal end of the valve housing.

It may be advantageous to position the outlet port in an outlet plane which is orthogonal to the central axis of the gas lift valve.

It may be advantageous that the central axis runs through the outlet port. Also, it may be advantageous that the outlet port is circular and co-axial with the central axis of the gas lift valve.

It may be advantageous that the valve body comprises:

- a downstream end section, on the outer, annular surface of which the sealing surface is located,
- a blind bore which forms a central, axial channel in the valve body, which blind bore runs from an upstream, central orifice of the valve body and terminates at the end section, which orifice is in fluid communication with the inlet port, and
- a plurality of generally radial through bores which extend into the central channel at the end section and form fluid openings in the valve body, which fluid openings open upstream of the sealing surface and is in fluid communication with the outlet port only when the gas lift valve is in the open position.

The gas lift valve may advantageously comprise a spring element that biases the valve body towards the closed position.

The present gas lift valve comprises a valve housing and movable parts in the form of valve elements, including a valve body, which are arranged within the valve housing. The gas lift valve further comprises an inlet port allowing gas to enter the gas lift valve from the annulus surrounding the production tubing and an outlet port through which gas is injected into the produced well fluids. The gas lift valve may be provided with a single outlet port or with a plurality of outlet ports. At the chosen gas lift valve inclination angle there will be a point of one outlet port, or possibly several outlet ports, which will be placed at the vertically highest point P, i.e. the last point or part of the outlet port or outlet ports that a horizontal water surface will cover when the vertical level of the horizontal water surface rises. As the horizontal water surface reaches the vertically highest point P of the outlet port (or outlet ports if there is a plurality of outlet ports with their highest vertical point at the same vertical level), the outlet port or outlet ports will be situated just below the horizontal water surface and a water lock will form preventing more water to enter through the outlet port or outlet ports. The present invention therefore suggests that if all movable parts of the gas lift valve, in all their positions within the valve housing for the inclination angle of the production tubing that the gas lift valve is arranged in (and thus the inclination angle of the gas lift valve), is above the horizontal water surface when the horizontal water surface passes through the highest vertical point P of the outlet port or outlet ports, the water lock that forms will prevent the movable parts within the gas lift valve from getting wet. Formation of scale on the movable parts of the present gas lift valve will therefore at least be greatly reduced and probably avoided altogether.

A gas lift valve for use in a hydrocarbon well is therefore provided, the gas lift valve comprising:

- a valve housing with a longitudinal central axis A, at least one inlet port, and at least one outlet port,
- at least one valve element which is mounted in the valve housing movable relative to the valve housing, where the at least one outlet port has a vertically highest point P for a chosen gas lift valve inclination angle β, where β is the angle between a vertical line V and the longitudinal axis A of the valve housing, and the gas lift valve is provided with a distance L, measured along the longitudinal axis A, between said at least one valve element in its position nearest the at least one outlet port and a plane through said point P orthogonal to the longitudinal axis A, such that the entire at least one valve element is above a horizontal plane passing through said vertically highest point P of the at least one outlet port.

Thus the distance L is the shortest distance between a plane which is orthogonal to the longitudinal axis A and passes through the part of the movable valve element nearest the at least one outlet port when the valve element is in its nearest position to the at least one outlet port and a plane which passes through the point P of the at least one outlet port and is orthogonal to the longitudinal axis A.

The angle β refers to the angle of inclination of the production tubing, and thus the gas lift valve, for a given well at a given position in the well. The angle of the well will obviously be different from one well to another well, but the present invention will work for inclination angles, i.e. the angle β, within a range of 0°-75°. More commonly the present invention is expected to be used for inclination angles β within a range of 20°-70°, and possibly most likely for angles of β within a range of 25°-60°.

In an embodiment of the present invention the valve housing may be provided with one outlet port. The single outlet port is preferably provided centrally at a terminal end of the gas lift valve such that the longitudinal axis A passes through the outlet port, preferably through the centre of the outlet port. Since it is desirable to reduce the pressure drop across the at least one outlet port, the outlet port may be provided with a circular shape. The position of the vertically highest point P of the outlet port is then a function of the diameter of the outlet port.

Alternatively the valve housing may be provided with a plurality of outlet ports. The vertically highest point P will then be the point of the outlet port with the opening reaching the vertically highest position of all the outlet ports (or outlet ports if there are two or more outlet ports which reach the same vertically highest position). For the same reason as above, the outlet ports are preferably substantially circular.

The valve housing may comprise a nose element having a conical section with an end portion, where the at least one outlet port is arranged in the end portion. The end portion is preferably substantially plane and is preferably substantially orthogonal to the longitudinal axis A.

In an embodiment of the present invention, the at least one outlet port are provided in the end portion. Alternatively, the at least one outlet port is arranged in a conical section of the valve housing. The at least one outlet port may also be arranged laterally in a cylindrical section of the valve housing.

In an embodiment of the present invention, the valve element which is closest to the at least one outlet port, is a valve body. The valve element may, however, be other types of elements which are movable relative to the valve housing such as a spring, a valve seat etc. The important thing is that the valve element of the present invention is the valve element which has its nearest position to the outlet port with the vertically highest point P which is nearer than the other valve elements of the gas lift valve. If this valve element in its entirety is situated above a horizontal plane through the vertically highest point P of the at least one outlet port, in all its positions, then all the other valve elements will also be situated above said horizontal plane.

A non-limiting embodiment of the present invention will now be explained in detail with reference to the figures where:

FIG. 1 illustrates what the applicant believes is the cause of formation of scale on known gas lift valves.

FIG. 2 schematically illustrates the principle behind the present invention.

Figure 1:
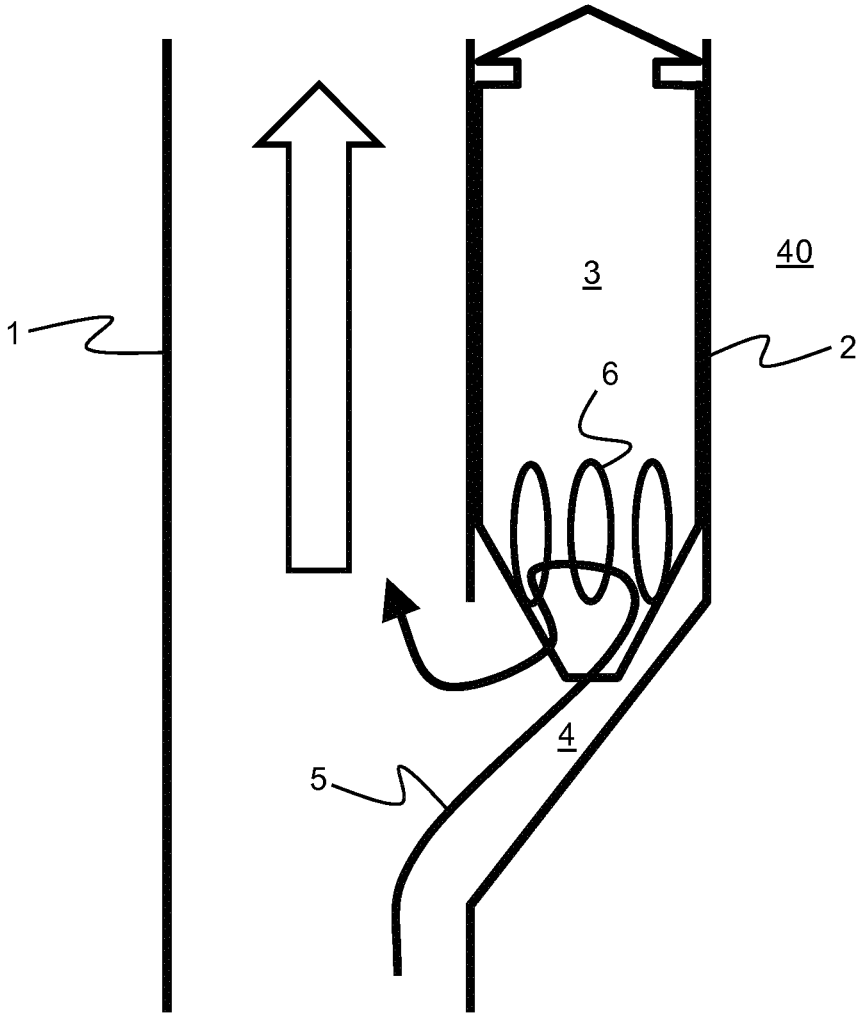
Fig. 1 (Prior Art)

As discussed above, FIG. 1 illustrates a gas lift valve arranged in a side pocket of a production tubing and how turbulent reservoir water enters into the interior of the gas lift valve through the outlet ports and over time causes scale to form on interior parts of the gas lift valve. Movable parts of the gas lift valve may therefore eventually get stuck. To avoid this problem, the present invention contemplates a solution as disclosed in FIGS. 2-8. In FIGS. 2-8 the same reference number have been used for the same technical features.

Figure 2:
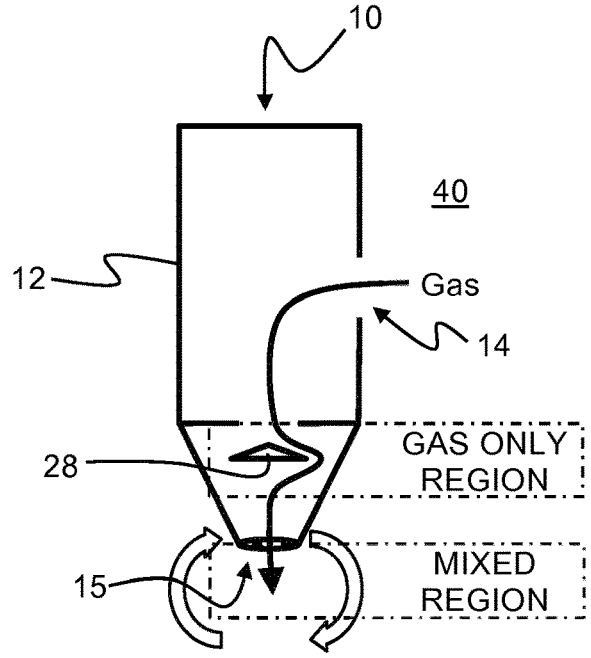

In FIG. 2 the suggested solution to the problem of formation of scale on the movable interior parts of the gas lift valve is illustrated schematically. The gas lift valve 10 comprises a valve housing 12 with an inlet port 14 and an outlet port 15. In the valve housing there is provided a valve body 28 which is movable between a first position, in which the gas lift valve 10 is closed for flow of any fluid through the gas lift valve, and a second position in which gas can flow from the annulus 40 through the gas lift valve and through the outlet port 15 as indicated with the arrow on FIG. 2. The idea is to keep the movable parts of the gas lift valve in a gas only region and to keep the water in a mixed region, i.e. a region with a mix of gas flowing through the gas lift valve and reservoir water which has entered through the outlet port, closer to the outlet port away from the valve elements which are movable relative to the valve housing. How this can be solved, will be explained below.

Figure 4:
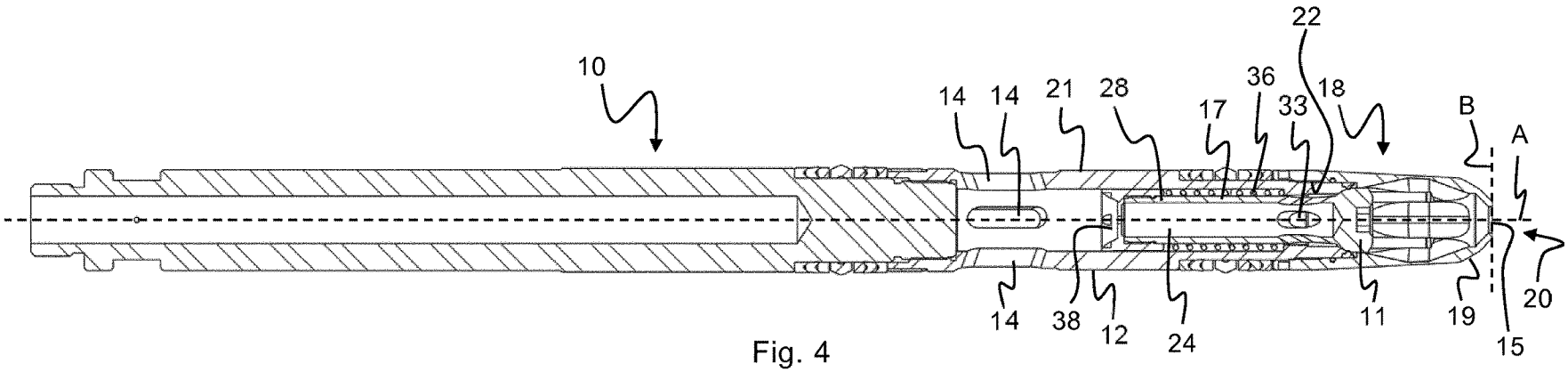
FIG. 4 shows the gas lift valve according to FIG. 3 in a sectional view, in which view the gas lift valve is in a closed position.
Figure 5:
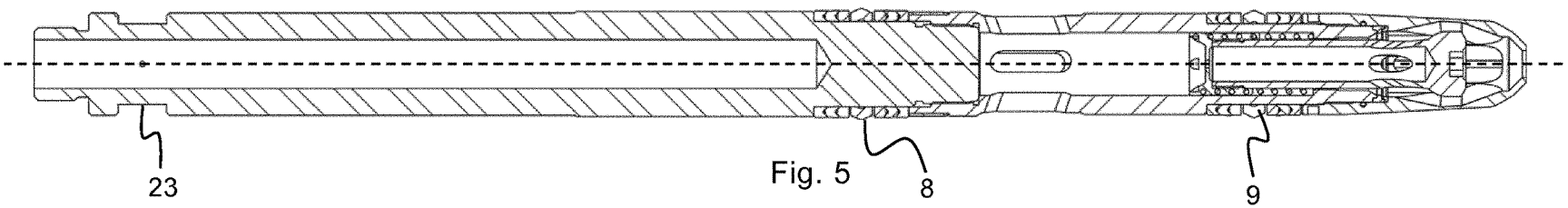
FIG. 5 shows the gas lift valve according to FIG. 3 in a sectional view, in which view the gas lift valve is in an open position.
Figure 6:
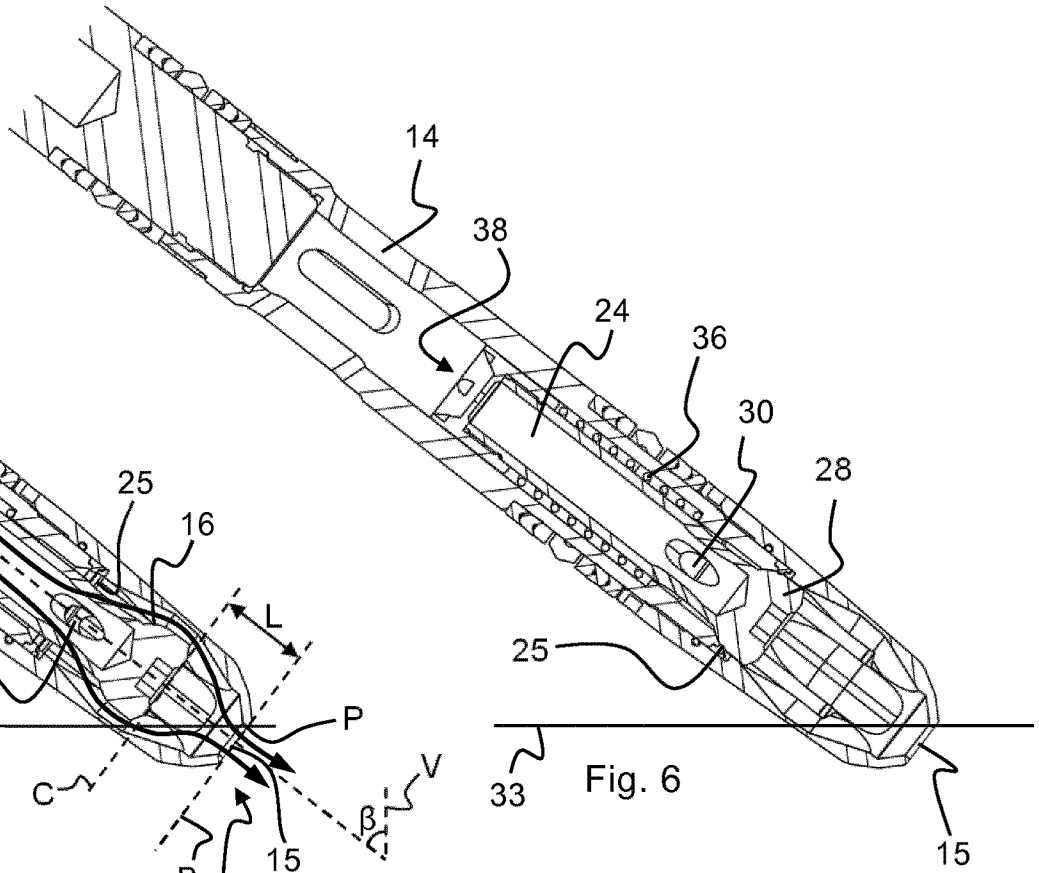
FIG. 6 shows a section through a lower part of the gas lift valve according to FIG. 3, in which view the gas lift valve is in a closed position.

In FIGS. 3-8, a more detailed representation of an embodiment of the gas lift valve 10 according to the present invention is shown. FIGS. 4 and 6 disclose the valve 10 in a closed position and FIGS. 5, 7 and 8 disclose the valve 10 in an open position.

The gas lift valve 10 comprises a valve housing 12 with a longitudinal axis A and at least one inlet port 14 or a plurality of inlet ports 14 arranged around the circumference of the valve housing.

A nose element 18 is attached to the rest of the valve housing 12 with a threaded connection 22 and comprises a cylindrical section 21, a conical section 19 and end portion 20 at the terminal end of the conical section 19. The end portion 20 can be substantially plane as indicated on FIG. 4, where the end portion 20 is arranged in a plane B which is substantially orthogonal to the longitudinal axis A, but may also be given a different shape, for example a curved shape if the end portion is provided with a plurality of smaller outlet ports rather than one outlet port 15 as shown on the figures.

Consequently, the nose element 18 is hollow and encloses an internal volume or chamber 13 (cf. FIG. 8) which is in fluid communication with the outlet port 15.

Figure 8:
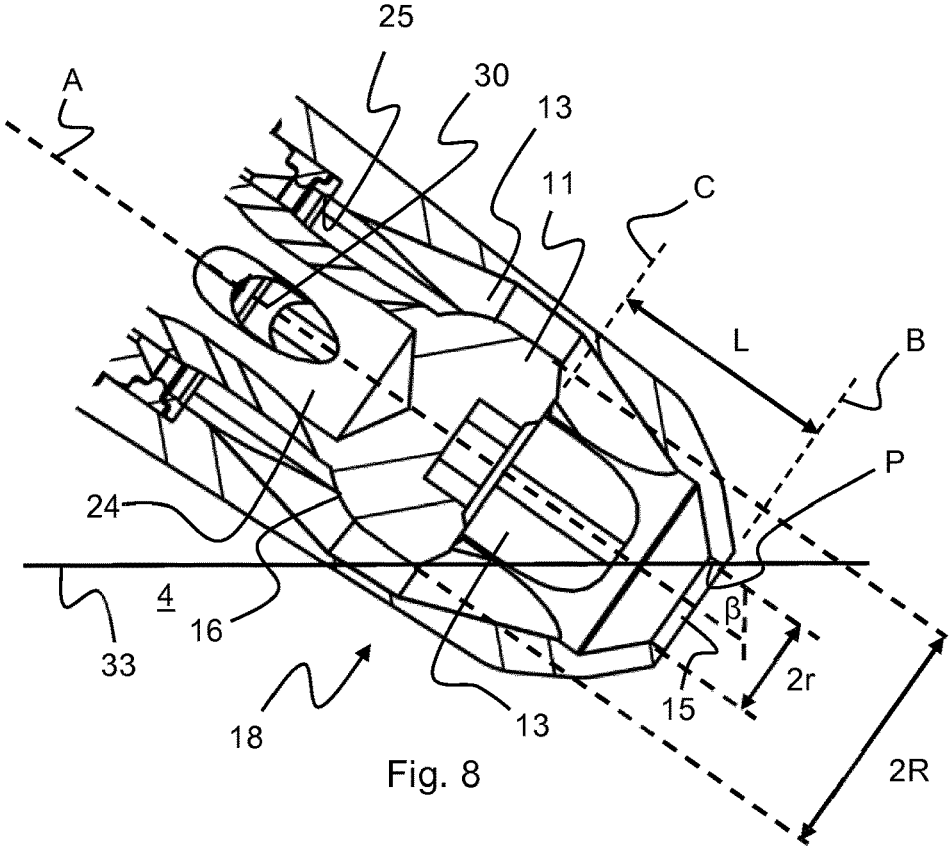
FIG. 8 shows a detailed view of the nose element of the gas lift valve according to FIG. 7.
Figure 3:
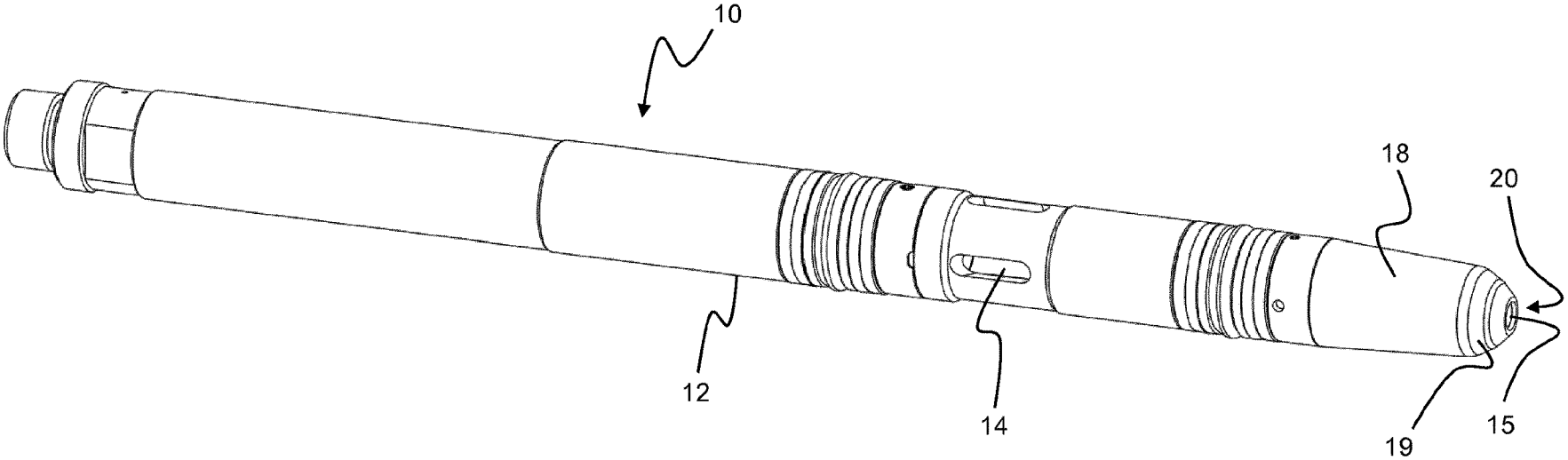
FIG. 3 shows an embodiment of a gas lift valve according to the present invention.
Figure 7:
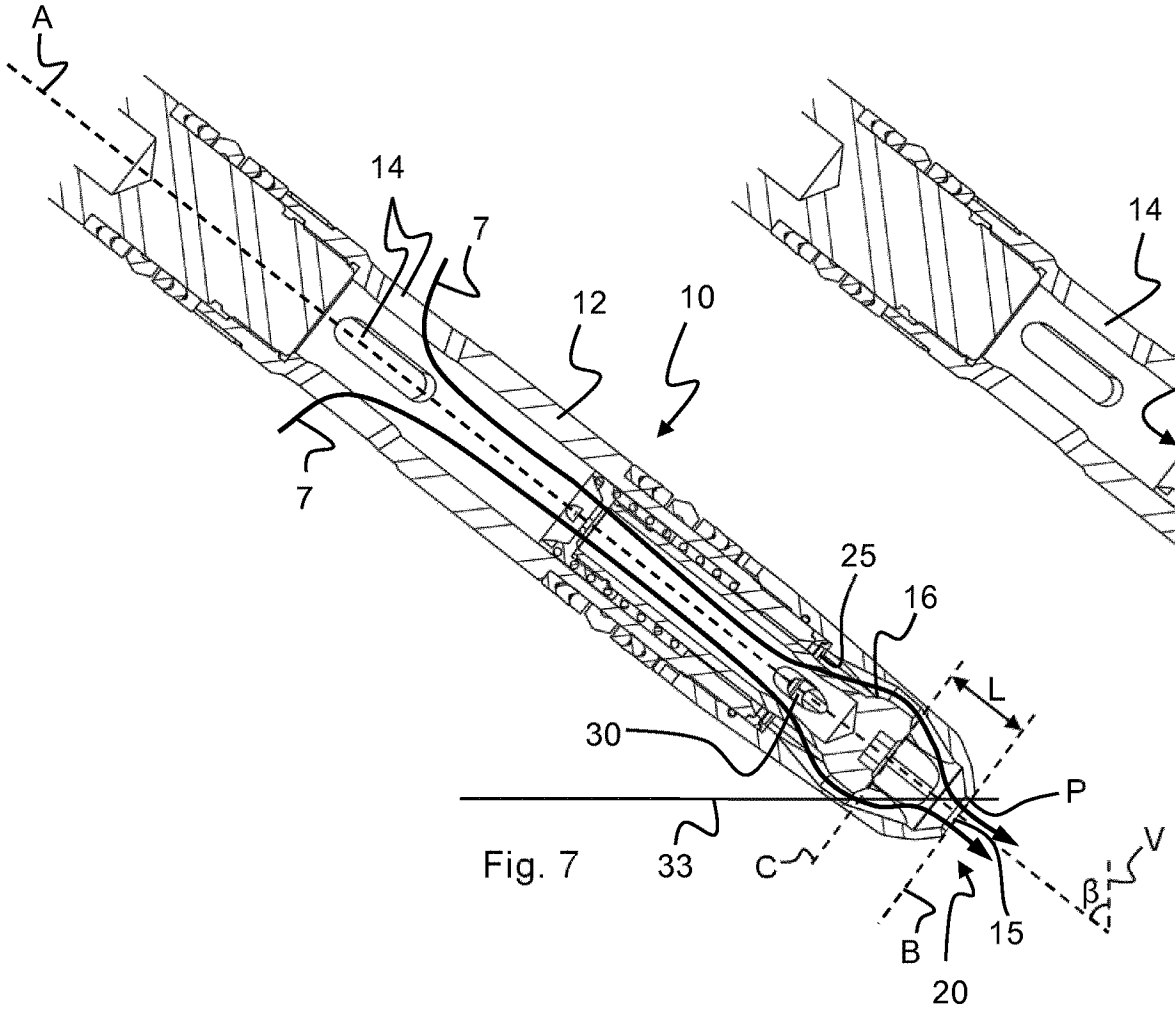
FIG. 7 shows a section through a lower part of the gas lift valve according to FIG. 3, in which view the gas lift valve is in an open position.

The gas lift valve 10 further comprises a valve body 28 which is movably mounted in the valve housing between a first position, in which the gas lift valve is closed for fluid flow through the gas lift valve, as is disclosed in FIGS. 4 and 6, and a second position in which the gas lift valve is open for gas flow through the gas lift valve, as is disclosed in FIGS. 5, 7 and 8.

As is disclosed in FIGS. 6 and 7, the valve body 28 has an elongated form and comprises a first, upstream section 17 and a second, downstream end section 11. The first section 17 comprises a blind bore 24 which forms a central, axial channel of the valve body 28, which blind bore 24 runs from an upstream, central orifice or orifice element 38 of the valve body 28 and terminates at the end section 11.

The end section 11 has a diameter which is larger than the diameter of the first section 17, i.e. the section housing the blind bore 24 (also cf. FIG. 8).

The valve body 28 further comprises a plurality of generally radial through-bores 30 which extend into the axial channel 24 at the end section 11 and form fluid openings in the valve body 28. Consequently, the axial channel 24 and the radial fluid openings 30 form a fluid path through the valve body 28, which fluid path, at the upstream end of the valve body 28, is in fluid communication with the inlet ports 14 via the orifice 38.

In FIGS. 4 and 6 the gas lift valve 10 is shown in the first, closed position, where the valve body 28 or, to be more precise, an outer, annular sealing surface 16 of the end section 11 of the valve body 28, is abutting an inner, annular valve seat surface or valve seat 25 of the valve housing 12. The fluid openings 30 open upstream of the sealing surface 16 and, consequently, the fluid path through the valve body 28 is closed for through-flow when the valve body is in this position.

As is evident from FIG. 8, the annular valve seat 25 forms the upstream boundary of the chamber 13 and the outlet port 15 forms the downstream boundary of the same.

In FIGS. 5, 7 and 8, the gas lift valve 10 is shown in the second, open position. In this position, the valve body 28 has been moved in the longitudinal direction of the valve housing 12 such that the sealing surface 16 is no longer abutting the valve seat 25 and, consequently, the fluid path through the valve body 28 and the gas lift valve 10 is no longer blocked. As is indicated by the arrows 7 in FIG. 7, the fluid path runs from the inlet ports 14, through the orifice 38, through the channel 24, through the radial fluid openings 30, through the camber 13 and out through the central outlet port 15 at the terminal end 20 of the valve 10.

A spring element 36 biases the valve body 28 towards the closed position, as is disclosed in FIG. 6. However, when the fluid pressure of the injection fluid at the inlet ports 14 become large enough, the end section 11 of the valve body 28 will be lifted from valve seat 25 such that injection fluid is allowed to flow through the gas lift valve 10 from the inlet ports 14 to the outlet port 15.

Thus, when gas is to be injected into the produced well fluids, the gas pressure in the annulus is increased until gas pressure at the inlet ports 14 is greater than the closing force produced by the spring element 36, at which time the valve body 28 moves away from the valve seat 25 such that gas can flow through the valve body 28 and further through the outlet port 15.

By arranging the outlet port 15 at the end portion 20 of the gas lift valve 10, the movable members of the gas lift valve, i.e. the valve body 28 and the spring element 36 in the present case, will not come into contact with well fluids even if the gas lift valve 10 is operated at an inclined angle, i.e. at an angle where the longitudinal axis A deviates from a vertical orientation.

As indicated in FIGS. 7 and 8, the gas lift valve 10 is arranged at an angle β relative to a vertical line V. For a given inclination angle β, a horizontal plane 33, like the surface of the reservoir water, can be drawn through the vertically highest point of the outlet port 15. Water will then partially fill the nose element 18 as is indicated in FIG. 7. When the water surface passes through the vertically highest point P of the outlet port 15, a water lock is formed and even if the water level rises further so that the water surface is higher than the plane 33 through the vertically highest point P of the outlet port, no more water will enter through the outlet port 15 and the water level within the valve housing will stay at the same level as if the water surface outside the valve housing is level with plane 33.

In other words, as long as the vertically highest point of the outlet port 15 is kept lower than the valve body 28, the valve body 28 will not come into contact with the reservoir water and scaling can be prevented.

In FIGS. 7 and 8 there is shown a plane B which passes through point P and is orthogonal to the longitudinal axis A. Another plane C passes through the terminal end of valve body 28, i.e. the terminal end of the end section 11 (or the valve element which is nearest the outlet port 15) and is also orthogonal to the longitudinal axis A.

To avoid that reservoir water wets the movable parts of the gas lift valve, the gas lift valve 10 is therefore designed such that a distance L between the planes B and C, measured along the longitudinal axis A, when the valve body 28 is in its nearest position to the outlet port 15, is such that the entire valve body 28 is above a horizontal plane 33 passing through the vertically highest point P of the outlet port 15. Because of the water lock effect described above, the region above plane 33 will be a "gas only region" as described in connection with FIG. 2 above. As long as the movable valve element which is nearest the outlet port 15, is situated above the plane 33 in all its positions relative to the valve housing 12, it will not be affected by the reservoir water, which will substantially remain in the "mixed region" below the plane 33. Since the valve element which is nearest the outlet opening and most prone to get wetted by the reservoir water, will be unaffected by the water, the other valve elements, which are movable relative to the valve housing 12, will obviously also be unaffected by the reservoir water.

Thus by designing the gas lift valve 10 with respect to the distance L between the movable valve element nearest to the outlet port 15 and the position of the vertically highest point P of the outlet opening 15 such that the entire movable valve element in all its positions is above a horizontal plane 33 through the point P, a gas lift valve is achieved where the formation of scale on the movable parts of the gas lift valve is avoided.

It should be noted that the moving valve elements in the embodiment of the present invention shown on the figures are the valve body 28 and the spring element 36 and that the valve element nearest to the vertically highest point P of the outlet port is the valve body 28. In other embodiments of the gas lift valve, other parts of the valve may be movable relative to the valve housing 12. For example, it would be possible to arrange the gas lift valve such that the valve seat is the movable part or the position of the interior parts of the gas lift valve may be arranged such that the orifice element 38 is the movable valve element which is nearest to the outlet port or outlet ports 15. Hence, the valve element which is nearest to the outlet port 15 with the vertically highest point P may be the valve body 28, as shown in the figures, or it may be another movable part of the gas lift valve depending on the specific construction of the gas lift valve in question.

It may be advantageous to design the gas lift valve such that it can operate at an inclination angle β which is within the range of 0-70° without allowing the valve body 28 to come into contact with the reservoir water. This may advantageously be realized by forming the outlet port 15 as a circular opening and positioning the port 15 co-axial with the longitudinal axis A of the gas lift valve, as is disclosed in FIGS. 3-8.

It may further be advantageous to design the gas lift valve 10 such that the radius r of the outlet port 15 is less than the radius of the largest section of the valve body 28, i.e. the radius R of the end section 11 of the valve body 28 (cf. FIG. 8).

Also, the lowermost allowable position of the valve body 28, i.e. the position of the valve body 28 when in a maximum open position, should be sufficiently distant from the outlet port 15 such that the valve body 28 is kept above the level of the outlet port 15. In particular, it may be advantageous that said distance L between the lowermost position of the valve body and the outlet port is equal to or larger than:

$$(R+r)/\tan(90°-\beta) \quad (3)$$

where R is the radius of the end section 11 of the valve body 28, r is the radius of the outlet port 15, and β is the inclination of the gas lift valve.

For example, if the inclination β is 45°, the distance L should advantageously be equal to or larger than R+r.

In operation, the gas lift valve 10 is positioned in a side pocket mandrel in a conventional manner, i.e. such that the inlet ports 14 is in fluid communication with inlet openings in the side pocket mandrel, which inlet openings opens into an annulus of the well bore. In order to prevent leakage between the annulus and the production tubing, the gas lift valve 10 comprises annular seals 8, 9 on either side of the inlet ports 14. Also, for inserting and removing the gas lift valve 10 from a side pocket in the side pocket mandrel, the body of the gas lift valve 10 comprises an annular recess 23 providing an interface for a gas valve replacement tool, e.g. a kick-over tool, which can be run down the production tubing to mount or remove the gas lift in a conventional manner.

The invention claimed is:

1. A gas lift valve for use in a hydrocarbon well, comprising:

an elongated valve housing comprising an inlet port for receiving a fluid from an annulus of a hydrocarbon well, and an outlet port for delivering the fluid to a production tubing of the hydrocarbon well; and an elongated, internal valve body, which is movable along a longitudinal, central axis of the valve housing between a first end position and a second end position, in which first end position a sealing surface of the valve body is in sealing contact with a valve seat surface of the valve housing prohibiting the fluid to flow from the inlet port to the outlet port, and in which second end position the sealing surface is separated from the valve seat surface allowing the fluid to flow from the inlet port to the outlet port, wherein the outlet port is positioned at a terminal end of the valve housing, wherein the valve body comprises:

a downstream end section, the sealing surface being located on an outer, annular surface of the downstream end section;

a blind bore which forms a central, axial channel in the valve body, said blind bore running from an upstream, central orifice of the valve body and terminates at the downstream end section, said upstream, central orifice being arranged at an opposite end of the valve body compared to the downstream end section, and being in fluid communication with the inlet port; and a plurality of generally radial through bores extending into the axial channel at the downstream end section and forming fluid outlet openings in the valve body for the fluid to pass through from the axial channel to the outlet port, said fluid outlet openings opening upstream of the sealing surface and being in fluid communication with the outlet port only when the gas lift valve is in an open position where the valve body is in the second end position, wherein the gas lift valve comprises a spring element biasing the valve body towards a closed position where the valve body is in the first end position, wherein the outlet port is axially spaced from the valve body without overlapping with the valve body in a radial direction that is orthogonal to the longitudinal, central axis of the valve housing when the valve body is in the second end position, and wherein the plurality of generally radial through bores are arranged downstream of the central, axial channel, such that a fluid path is formed running from the inlet port through the upstream, central orifice, then through the central, axial channel, then through the plurality of generally radial through bores, and then out through the outlet port.

2. The gas lift valve according to claim 1, wherein the outlet port is positioned in an outlet plane which is orthogonal to the central axis.

3. The gas lift valve according to claim 2, wherein the central axis runs through the outlet port.

4. The gas lift valve according to claim 1, wherein the central axis runs through the outlet port.

5. The gas lift valve according to claim 4, wherein the outlet port is circular and co-axial with the longitudinal, central axis.

6. The gas lift valve according to claim 1, wherein the outlet port has a vertically highest point for a chosen gas lift valve inclination angle β, where β is the angle between a vertical line and the longitudinal axis of the gas lift valve, and the gas lift valve is provided with a distance, measured along the longitudinal axis, between said valve body in its position nearest the outlet port and a plane through said point orthogonal to the longitudinal axis, such that the entire valve body is above a horizontal plane passing through said vertically highest point of the outlet port.

7. The gas lift valve according to claim 6, wherein the angle β is within a range of 0°-75°.

8. The gas lift valve according to claim 6, wherein the angle β is within a range of 20°-70°.

9. The gas lift valve according to claim 6, wherein the angle β is within a range of 25°-60°.

10. The gas lift valve according to claim 1, wherein the valve housing comprises a nose element having a conical section with an end portion, wherein the outlet port is arranged in the end portion.

11. The gas lift valve according to claim 1, wherein the outlet port is a single outlet port provided centrally at a distal end of the gas lift valve.

12. The gas lift valve according to claim 11, wherein the distal end of the gas lift valve which forms the outlet port is planar and orthogonal to the longitudinal, central axis of the valve housing.

13. The gas lift valve according to claim 1, wherein the valve housing comprises a nose element enclosing an internal chamber, and the internal chamber is positioned between the valve body and the outlet port, and is in fluid communication with the outlet port, such that the fluid discharged from the plurality of generally radial through bores passes through the internal chamber to the outlet port.

14. A method of injecting an injection fluid into a well fluid of a production tubing of a hydrocarbon well, said method comprising the steps of:

using the valve according to claim 1; and injecting the injection fluid into the well fluid without allowing the well fluid to come into contact with the valve body.

15. The method according to claim 10, wherein the position of the outlet port allows the gas lift valve to operate with the central axis at an angle up to 70 degrees from the vertical without allowing fluid in the production tubing to come into contact with the valve body.

* * * * *